United States Patent [19]

Jezbera

[11] 4,422,377

[45] Dec. 27, 1983

[54] PRINT HAMMER AND COIL ASSEMBLY

[75] Inventor: Val K. Jezbera, Thousand Oaks, Calif.

[73] Assignee: Dataproducts Corporation, Woodland Hills, Calif.

[21] Appl. No.: 223,937

[22] Filed: Jan. 9, 1981

Related U.S. Application Data

[63] Continuation of Ser. No. 23,739, Mar. 26, 1979, abandoned.

[51] Int. Cl.[3] ..... B41J 9/38

[52] U.S. Cl. ..... 101/93.29; 101/93.48; 336/231

[58] Field of Search ..... 101/93.29–93.34, 101/93.48; 336/231, 189, 190, 205, 225, 227, 232

[56] References Cited

U.S. PATENT DOCUMENTS

| | | | |
|---|---|---|---|
| 1,445,896 | 2/1923 | Lane | 336/190 X |
| 1,955,318 | 4/1934 | West et al. | 336/231 X |
| 2,438,935 | 4/1948 | Ambrose | 336/231 X |
| 3,372,357 | 3/1968 | Dietzel et al. | 336/231 X |
| 3,412,354 | 11/1968 | Sattler | 336/205 |
| 3,735,698 | 5/1973 | Undas et al. | 101/93.34 |
| 4,129,390 | 12/1978 | Bogelon et al. | 101/93.29 X |

FOREIGN PATENT DOCUMENTS

| | | | |
|---|---|---|---|
| 1538129 | 7/1969 | Fed. Rep. of Germany | 336/231 |
| 2316870 | 3/1975 | Fed. Rep. of Germany | 336/190 |

*Primary Examiner*—Edward M. Coven

*Attorney, Agent, or Firm*—Spensley, Horn, Jubas & Lubitz

[57] ABSTRACT

Disclosed is a unique wire coil having flat sides and a maximum packing density. The coil is wound in a hex fashion (i.e., with each interior turn of the coil being in contact with six other turns of the coil) and has a plurality of turns and a plurality of layers of turns. The coil is wound generally perpendicular to a central axis, and each layer of turns is wound at an angle of approximately 30 degrees with respect to the axis, which results in a coil having flat sides.

7 Claims, 9 Drawing Figures

PRINT HAMMER AND COIL ASSEMBLY

This is a continuation, of application Ser. No. 23,739, filed 3/26/79 abandoned

BACKGROUND OF THE INVENTION

1. Field of the Invention

This invention relates to wire coils and particularly to the packing configuration of wire coils.

2. Prior Art

When a wire is wound about an axis in order to form a coil, each revolution of the wire about the axis is referred to as a turn. Most coils have a plurality of turns which are wound adjacent to one another. In addition, coils usually have a plurality of layers of turns. That is, one layer of turns is formed by winding a plurality of turns adjacent to one another. A second layer of turns is then formed by winding the wire over the first layer of turns. The circumference of each succeeding layer of turns is greater than the preceding layer of turns. The way in which an individual turn contacts adjacent turns in a formed coil is referred to as its packing arrangement. One typical packing arrangement is known as a square lay. In this type of packing, which is shown in the drawings in FIG. 6, each interior turn of the coil is in direct contact with four other turns. This type of arrangement results in a relatively poor filling factor, i.e., there is a great deal of open space between individual turns. An arrangement which is more efficient is known as a hex winding or a perfect lay, and is shown in FIG. 7 of the drawings. In coils wound in this fashion, each interior turn is in contact with six other turns and the open space between individual turns is greatly reduced. A coil of this type is disclosed in U.S. Pat. No. 2,559,824, issued to G. J. Leland on July 10, 1951.

Although the hex packing arrangement has a relatively high filling factor, coils which employ it do not have flat sides. That is, all of the turns on either side of the coil do not lie in the same plane. This reduces the amount of wire which may be packed into a given width. This problem becomes critical when the width within which a coil must fit is extremely limited, such as is the case with printer hammers. The thickness of the coil generally must be less than 0.03 inches. Within this thickness, it is imperative that as much wire as possible be wrapped in order to form a coil having the maximum flux density for a given current. Within a given space, the coil having the highest packing density will give the best performance.

One method which may be utilized to aid in the formation of coils is to apply a packing pressure to the peripheral surface of a coil as it is being wound. Such an arrangement is illustrated in U.S. Pat. No. 1,383,186, issued to C. A. Brink on June 28, 1921. By utilizing this type of packing pressure, a tight pack is assured.

SUMMARY OF THE INVENTION

The present invention includes a multi-turn, multi-layer coil whose geometry is such that it has flat sides and a maximum packing density. Also included is a method and apparatus for forming the coil. The coil is wound in a hex fashion and individual turns are wound generally perpendicular to the central axis of the coil. Each layer of turns is slanted with respect to the central axis at an angle of approximately 30 degrees, thereby resulting in a coil having flat sides. That is, the axis of the wire at one end of every layer of the coil lies in a line generally parallel to one side of the coil and the axis of each wire at the other end of every layer lying in another line parallel to the other side of the coil. The coil can be wound with wire which has a coating of an epoxy adhesive material. The coil is then heated so as to cause the adhesive to become tacky and cause individual turns of the coil to adhere to one another. The coil is then cooled, and the epoxy solidifies resulting in a firm free-standing coil.

Wire is wound around a spindle in a generally perpendicular fashion so as to form the coil. Part of the spindle includes two parallel plates which are perpendicular to the axis of the spindle and define the space within which the coil is wound. The distance between the parallel plates is controlled so that the coil is wound in a hex fashion and so that each layer of turns of a coil is wound at an angle of approximately 30 degrees with respect to the central axis of the spindle. The packing arrangement is aided by having the winding surface of the core sloped also at an angle of 30 degrees with respect to the central winding axis. In order to insure a tight pack, packing means are included for applying guiding pressure to the outside of a being wound coil. The packing means may include a rotating wheel whose width corresponds to the width of the space within which a coil is wound and whose rim is slanted at an angle of 30 degrees with respect to the central winding axis and parallel to the winding surface of the spindle. The wheel is forced against the outside of the coil as it is wound so as to insure a tight pack.

BRIEF DESCRIPTION OF THE DRAWINGS

In the drawings, which are not necessarily to scale.

DETAILED DESCRIPTION OF THE DRAWINGS

Figure 1:
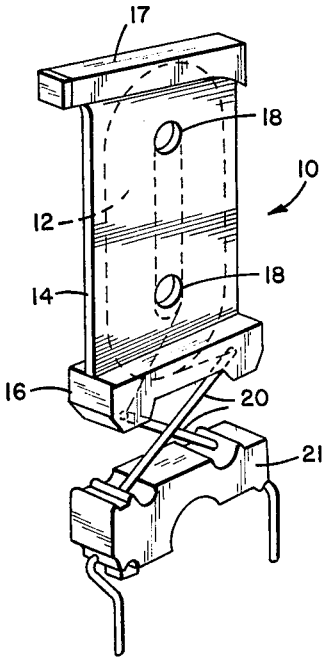
FIG. 1 is a side view, in schematic fashion, of a print hammer assembly for a high speed printer.
Figure 2:
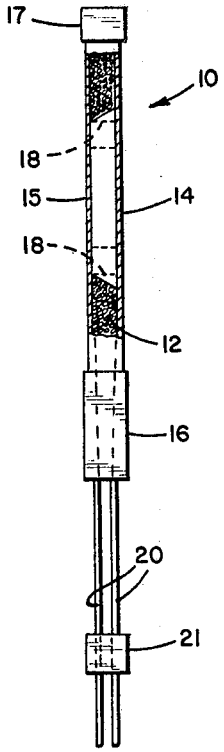
FIG. 2 is a front sectional view of the hammer of FIG. 1.

Referring to FIGS. 1 and 2, a hammer assembly 10. designed for use in an impact printer, includes a coil of wire 12 sandwiched between a pair of metal plates or flags 14 and 15. The metal plate 15 is embossed so as to provide a fitting which permits centering of the coil 12. A bottom section 16 and a top section 17, both of which are made of a high impact plastic, are connected to the metal plates 14 and 15. An opening 18 is formed on the metal plates 14 and 15 and passes through an opening in the middle of the coil 12. The leads of the coil 12 are connected to a pair of spring wires 20 which extend from the bottom of the plastic member 16. The wires 20 pass through a foot section 21, which aligns the wires 20 in proper relation to one another and aids in mounting the hammer 10.

Due to the restrictions on the thickness of the hammer 10, the coil 12 is wound so that its thickness is as small as possible. In the present embodiment of the invention, the thickness of the coil is less than 0.025 inches and the diameter of the wire which is used to form the coil is less than 0.006 inches. The coil 12 includes a plurality of turns and a plurality of layers of turns. The coil 12 is secured to the metal plates 14 and 15 by means of an epoxy adhesive, which will be described subsequently.

Figure 3:
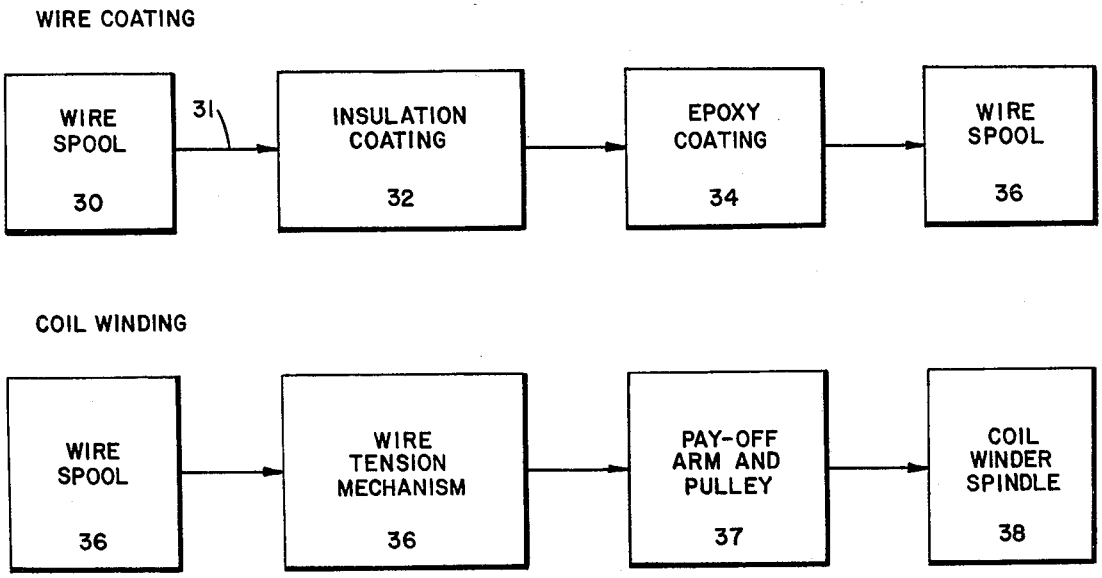
FIG. 3 is a schematic diagram of the coil assembly system of the present invention.

Referring now to FIG. 3, the process for forming the coil 12 will be described. Initially, a bare wire 31 is fed from a spool 30 through a coating apparatus 32 which coats the wire 31 with a thin layer of insulation. In an illustrative embodiment of the invention, the material used to insulate the wire 31 is a polyamide imide enamel, however, other materials may be used. The insulated wire 31 is then passed through a second coating apparatus 34 where it is coated with a thin overcoat of thermoplastic epoxy adhesive. The epoxy is such that it will become sticky or viscous when heated and then return to a hard, but thermoplastic (i.e., uncured) state when it cools. If enough heat is applied, the epoxy will begin to cure and will ultimately become thermost. The wire 31 passes from the epoxy coater 34 to a spool 36. It is subsequently transferred via a wire tension mechanism 36 and a pay-off arm and pulley 37 to a winder 38 upon which the coil 12 is formed. The wire tension mechanism 36 is designed to keep the wire 31 in tension with respect to the winder 38 so as to aid in the formation of a tightly wound coil. Such tension devices are well known in the art and need not be described in detail.

Figure 4:
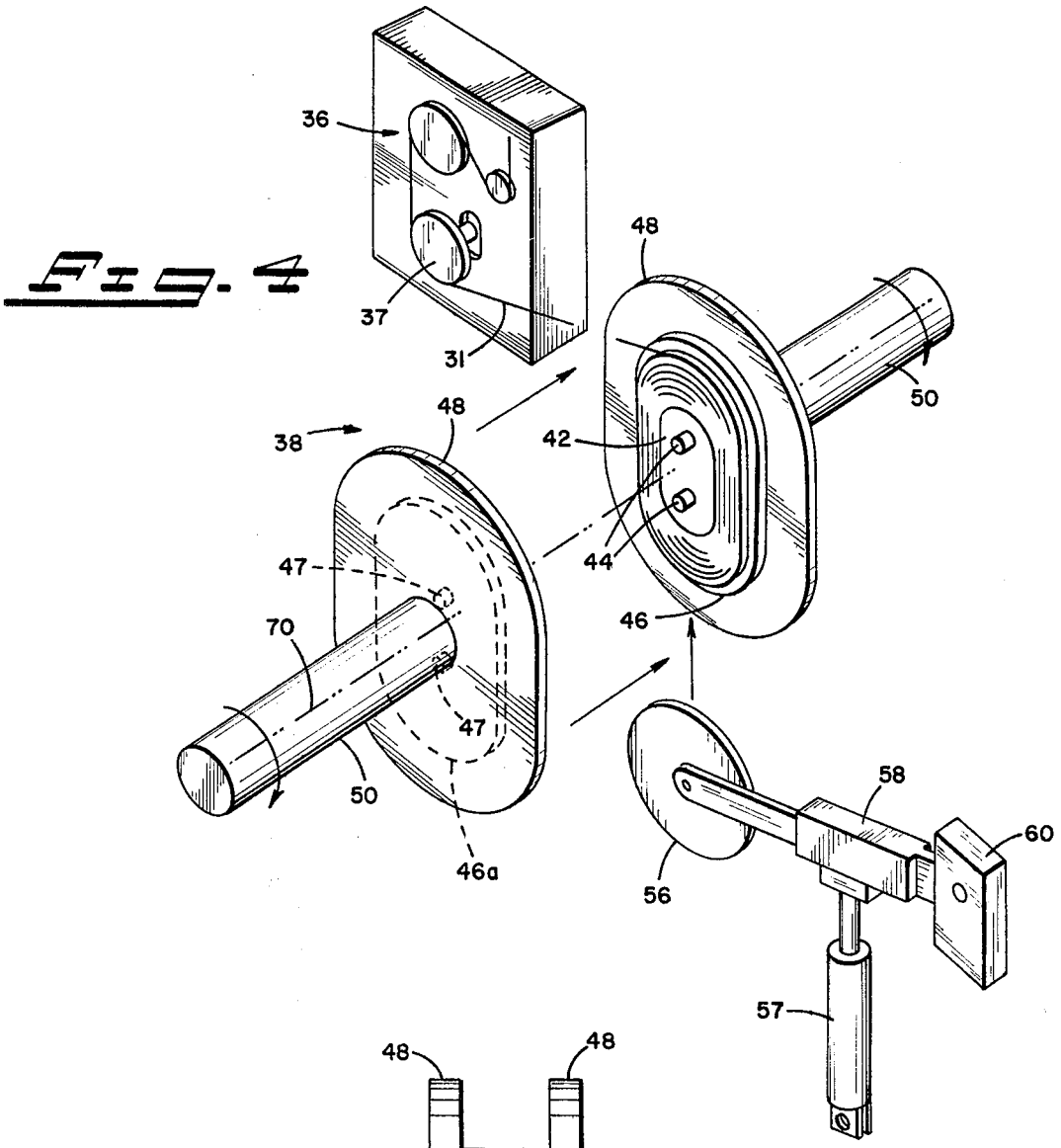
FIG. 4 is a perspective view of the winder portion of the coil assembly system, shown in an open position.

With reference to FIG. 4, the insulated and adhesive coated wire 31 is wound about a core 42 which is located in the winder 38. The winding of the wire 31 onto the core 42 is done about a central axis 70. The winding core 42 includes a pair of driving pins 44 located on its inner surface, and is attached to a fiberglass insulating plate 46. A second fiberglass insulating plate **46*a* includes a pair of holes 47 designed to mate with the pins 44. Each of the fiberglass insulating plates 46 and 46*a* is attached to a metal support plate 48 which is in turn attached to a drive shaft 50. The shaft 50 is driven by suitable drive means (not shown), which cause the shafts 50 to rotate and thus wind the wire 31 around the core 42 so as to form a coil 12. During winding, the insulating plate 46*a* is in contact with the core 42 (i.e., the pins 44 are mated with the holes 47) and the surfaces of the fiberglass insulating plates 46 and 46*a* define an opening between which the wire 31 is wound to form a coil 12**.

During the winding of a coil, pressure is applied to the peripheral surface of the being wound coil by means of a packing wheel 56 (i.e., to the outside surface of the outermost layer of the being wound coil). The wheel 56 is attached to one end of a bar 58, the other end of which is pivotally attached to a support member 60. An upward force is exerted on the bar 58 by suitable means so as to apply a bias which forces the wheel 56 into contact with the peripheral surface of the coil as it is being wound on the core 42. In the apparatus shown in FIG. 4, the bias is applied by means of an pneumatic piston and cylinder arrangement 57.

Figure 5:
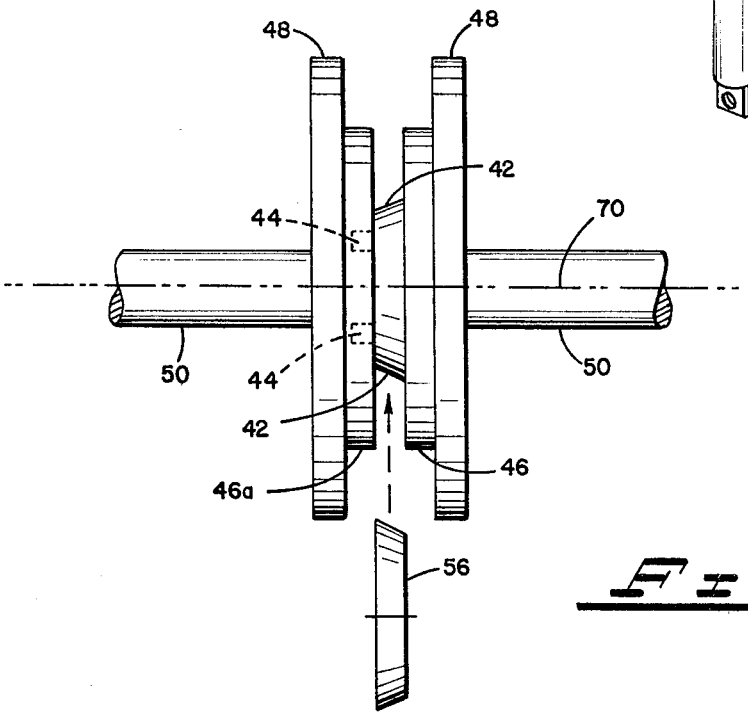
FIG. 5 is a side elevation view of the winder of FIG. 4, shown in the closed position in which winding takes place.

Referring now to FIG. 5, the core 42 has a winding surface **42*a* which is slanted at an angle of approximately 30 degrees with respect to the winding axis 70. The core 42 itself is perpendicular to the axis 70. The reason for this slant will be described subsequently. The rim of the packing wheel 56 is also slanted at a similar angle, (and is parallel to the winding surface 42*a*) and the width of the wheel 56 corresponds to that of the opening between the fiberglass plates 46 and 46*a*. The inner surface of the plates 46 and 46*a* are parallel and the width of the opening between them is therefore constant. Thus, during the winding of a coil the packing wheel 56 is inserted into the opening between the fiberglass plates 46 and 46*a* and pressed against the wire 31 as it is wound onto the core 42. The packing wheel 56 thus causes the wire 31** to be packed as tightly as possible as a coil is formed.

While a newly formed coil is still located on the winder 38, the coil is heated so as to cause the epoxy adhesive to soften and become tacky, which in turn causes each wire turn of the coil to adhere to adjacent wire turns. In the present embodiment of the invention, the coil is heated by passig an electric current through the coil itself for a predetermined amount of time sufficient to cause the adhesive coating to become tacky (but not so long as to cause the adhesive to begin to cure). The fiberglass plates 46 and **46*a*** serve to insulate the sides of the coil from heat loss and thus promote the uniform heating of the adhesive coating. Before the adhesive coating begins to cure, the heat is removed from the coil (i.e., the current is stopped) and the adhesive coating returns to a firm state. This bonds the individual turns of the coil together to form a firm self-supporting coil.

If coils are being produced for use in a printer hammer, subsequent to the cooling of a newly formed coil, it is removed from the winder 38 and assembled between two of the metal plates 14, 15. At this point the coil is heated to an extent so as to cause the epoxy adhesive to initially soften and subsequently begin to cure. The curing or thermosetting of the epoxy adhesive causes the plates 14 and 15 to be bonded permanently to the coil 12, as well as holding the coil in its original shape. The hardening of the adhesive results in a rigid, epoxy honeycomb sandwich structure being formed, with an embedded matrix of wires. That is, the plates 14, 15 form the outside panels of the sandwich, while the epoxy (which is adhered both to the plates 14, 15 and to the individual coil wires) forms the honeycomb in which the wires are embedded. In effect, the epoxy fills the interstices between the hex-pack wires shown in FIG. 8. The plates 14, 15 are bonded to the epoxy of the honeycomb arrangement on the sides of the coil 12, as shown in FIG. 2. This arrangement provides a great deal of rigidity and permits the use of very thin metal for the plates 14 and 15, with no significant reduction in the sturdiness of the hammer. The remainder of the assembly of the hammer 10 may then be completed in a normal fashion.

Figure 6:
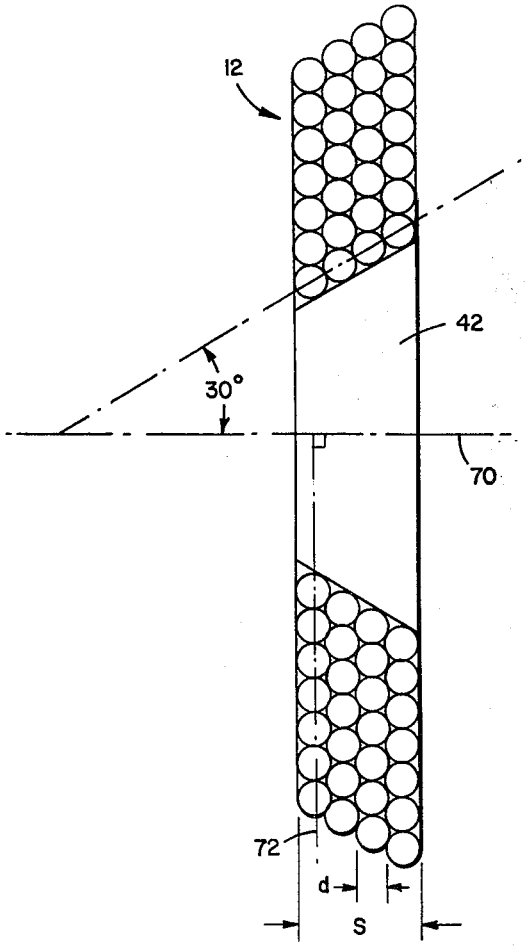
FIG. 6 is a schematic sectional view of a prior art square packing arrangement for wire coils.

Since the coil 12 which is used in the hammer assembly 10 is so thin, it is critical that as much wire as possible be wound within the thickness allotted for a coil. The amount of wire which may be wound is determined by how the coil is packed as it is wound, i.e., the way in which adjacent turns of the coil and adjacent layers of turns are in contact with each other. The least efficient prior art type of packing is known square packing, which is shown in FIG. 6. It can be seen that this type of packing results in a poor filling factor, as i.e., there is much open space between the wire turns of the coil.

Figure 7:
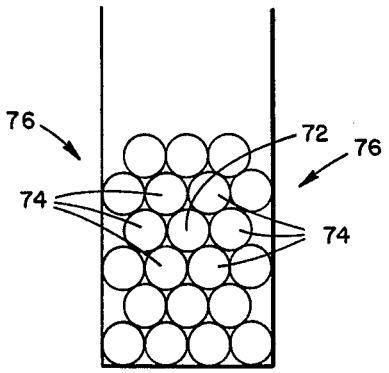
FIG. 7 (PRIOR ART)
FIG. 7 is a schematic sectional view of a prior art hex packing arrangement for coils.

The filling factor may be improved by packing the wire in what is known as a hex fashion, which is shown in FIG. 7. This arrangement is referred to as a hex pattern because each interior wire turn is in contact with six other wire turns. In FIG. 7, for example, a wire turn 72 is contacted by six wire turns 74. The problem with the normal hex packing (i.e., each layer of turns is parallel to the central axis of the coil) arrangement is that it results in a coil which does not have flat sides, as indicated by arrows 76. This reduces the amount of wire which may be wound within a given width.

Figure 8:
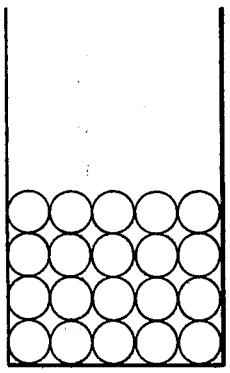
FIG. 8 (PRIOR ART)
FIG. 8 is a schematic sectional view of the packing arrangement utilized in the present invention.
Figure 9:
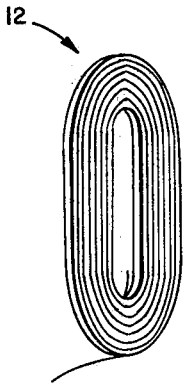
FIG. 9 is a perspective view of the coil of the present invention.

Referring now to FIGS. 8 and 9, coils which are wrapped on the core 42 overcome the problems of the normal hex packing arrangement. Specifically, coils formed have flat sides and are packed in a hex fashion and therefore fit a maximum amount of wire within a given width. As used herein, the term flat sides means that when viewed in cross-section as in FIG. 8, the axes of all adjacent wires on a side lie in the same plane. The drawing figure shows a coil 12 wrapped around the core 42. It can be seen that each layer of turns is formed at an angle of approximately 30 degrees with respect to the winding axis 70. The coil 12 is packed in a hex fashion, i.e., each interior turn of the coil 12 is in contact with six other turns. By packing each layer at an angle of 30 degrees with respect to the axis 70, however, both sides of the coil 12 are flat. This fact is illustrated by a line 72 which is drawn through the centers (or axes) of all of the turns on the left side of the coil 12. This packing arrangement results in a minimum amount of open space in the coil 12.

The critical factor in winding a coil with the desired 30 degree angle for each layer of turns (and therefore maximum packing density) is the width of the space within which the wire coil is formed. That is, for a given diameter of wire and a given number of desired turns for a coil, there is a particular width within which the coil should be wound so that it takes on the desired characteristics. The space within which a coil is wound should follow the relation $$S = d\,[(n-1)\cos 30^\circ + 1]$$

where S is the width of the space, d is the diameter of the wire (including any insulation and adhesive) and n is the number of turns per layer in the coil. In FIGS. 4 and 5, the distance between the fiberglass plates 46 and **46*a* (i.e., the thickness of the core 42) is controlled so as to follow the above relationship. The layers of the being wound coil are then automatically formed at an angle approximately 30 degrees with respect to the central axis 70 as the coil is wound and packed. The slanted surfaces of the core 42 and the packing wheel 56 aid in the formation of the coil, (i.e., the slanted surfaces of the wheel 56 serves to guide the wire into proper position), but they are not required. That is, the coil would take on the configuration of FIG. 8** even if these surfaces were not slanted.

In summary, the present invention includes a method and apparatus for forming a coil which is to be used in the hammer of a high speed printer. In addition, the coil is formed by a method and apparatus which themselves are unique. The coil has a plurality of turns and a plurality of successive layers of turns. The turns are generally perpendicular to the central axis of the coil and each layer of turns is slanted with respect to the central axis at an angle of approximately 30 degrees. This results in a coil having flat sides and a maximum packing density. The turns of the coil can be adhesively attached to one another by means of a thermoplastic epoxy or other adhesive coating on the coil wire which causes the coil to be free standing. The coil is particularly adapted for use in the mechanism of a high speed printer where the width of the coil is a critical factor. The hammer includes a rigid body member (made up of two metal plates) which sandwich the coil. The metal plates are secured to the coil by means of the epoxy adhesive which forms a honeycomb matrix for the structure.

The method of assembling the coil includes the steps of wrapping a wire in a generally perpendicular fashion about a central axis in a hex fashion to form a coil having a plurality of turns and a plurality of layers of turns. Each layer of turns is wound at an angle of approximately 30 degrees with respect to the central axis. The angle is achieved by controlling the width of the opening within which the coil is wound.

I claim:

1. A hammer for use in a high speed printer or the like comprising:

an elongated body member; and an elongated thin wire coil located within said body member, wherein said coil is hex-wound, has a plurality of turns and a plurality of successive layers of turns, wherein the number of said layers is substantially greater than the number of turns in each layer, said turns are generally perpendicular to the central axis of said coil, and each layer of turns is slanted with respect to said central axis at an angle of approximately 30 degrees with respect to said axis, wherein each turn at one end of each layer lies in a first common plane and each turn at the other end of each layer lies in a second common plane parallel to the first common plane, said coil having flat sides and maximum packing density.

2. The hammer of claim 1 wherein said body member includes a pair of narrowly spaced parallel plates and the sides of said coil are sandwiched between said plates, thereby achieving maximum wire packing with minimum hammer width.

3. The hammer of claim 2 wherein an adhesive surrounds the turns of said coil, thereby forming a honeycomb matrix, and wherein said plates are bonded to the sides of said coil by means of said adhesive.

4. A hammer for use in a high speed printer or the like, comprising:

a flat-sided, elongated coil having a plurality of turns, each turn comprising a revolution of wire about a central axis of the coil, said coil having a plurality of successive layers of turns each successive layer being spaced further from the central axis than the preceding layer, said coil characterized when viewed in a cross-section in a plane including the central axis of said coil, in that:

each layer of said coil contains the same number of turns;

the number of layers of turns is substantially greater than the number of turns in each layer;

the wire is packed in a hex fashion; and the axis of each wire at one end of every layer lies in a line parallel to a first side of said coil, the axis of each wire at the other end of every layer lies in another line parallel to the other side of said coil and parallel to the first side of the coil; and an elongated body member within which the coil is carried.

5. The print hammer of claim 4 wherein the wires of the coil are embedded in a honeycomb matrix of adhesive.

6. The print hammer of claim 5 wherein the body is comprised of a metal plate adjacent each side of the coil and attached to the adhesive matrix.

7. A print hammer for use in high speed printers or the like, said print hammer including:

a flat sided elongated multilayered coil characterized when viewed in a plane including the central axis of the coil in that each layer of the coil contains the same number of turns, the number of layers of turns exceeds the number of turns in each layer, the wire is packed in a hex fashion, the axis of each wire at one end of every layer lies in a line parallel to a first side of the coil, and the axis of each wire at the other end of every layer lies in another line parallel to the other side of the coil and parallel to the first side of the coil, wherein the number of turns in each layer of the coil is less than ten;

a honeycomb matrix of adhesive in which the wires of the coil are embedded; and a pair of metal plates, one adjacent to each side of the coil and attached to the adhesive matrix, wherein at least one of the metal plates includes a centering boss embossed on one side thereof for positioning the coil with respect to the plates.

* * * * *